United States Patent [19]

Nice

[11] Patent Number: 4,796,677

[45] Date of Patent: Jan. 10, 1989

[54] APPARATUS FOR FACILITATING LIQUID TRANSFER FROM A DRUM

[76] Inventor: Jeffrey D. Nice, 1515 Northridge, Columbus, Ohio 43224

[21] Appl. No.: 69,011

[22] Filed: Jul. 1, 1987

[51] Int. Cl.[4] ..... B67D 1/16

[52] U.S. Cl. ..... 141/88; 141/376; 222/109

[58] Field of Search ..... 141/88, 331, 332, 376, 141/115, 126; 285/390; 222/109, 111, 318, 383

[56] References Cited

U.S. PATENT DOCUMENTS

| | | | |
|---|---|---|---|
| 129,141 | 7/1872 | Kelly | 222/109 |
| 1,455,235 | 5/1923 | Townsend et al. | 222/109 |
| 1,517,805 | 12/1924 | Spaeth | 222/109 |
| 1,851,338 | 3/1932 | Wemple | 222/109 |
| 2,259,232 | 10/1941 | Stone | 285/390 X |
| 2,768,659 | 10/1956 | Kirkendall | 141/376 |
| 4,130,145 | 12/1978 | Thomas, Jr. | 141/88 |

*Primary Examiner*—Stephen Marcus
*Attorney, Agent, or Firm*—Barnes & Thornburg

[57] ABSTRACT

An apparatus for facilitating liquid transfer from a drum has a receptacle which has upper and lower portions. The lower portion is a generally conical member having an egress at its apex from which a first fluid coupling extends. The first fluid coupling has first and second threaded portions. The first threaded portion is more distal from the apex of the conical member and has an outside diameter smaller than the outside diameter of the second threaded portion. The first threaded portion is adapted to threadably engage a first threaded port of the drum and the second threaded portion is adapted to engage a second threaded port of the drum which is larger than the first port. The upper portion is a cylindrical skirt which extends axially from the periphery of the base of the conical member. An adaptable mounting bracket extends axially upwards from the upper portion. A second fluid coupling is mounted on a distal end of the adjustable mounting bracket and has an inlet end which is adapted to mate with an outlet hose of a pump used to pump liquid from the drum into a container which is supported by the receptacle. The second fluid coupling also has an outlet end which opens generally above the apex of the conical member and directs fluid into the container when the pumping occurs.

4 Claims, 1 Drawing Sheet

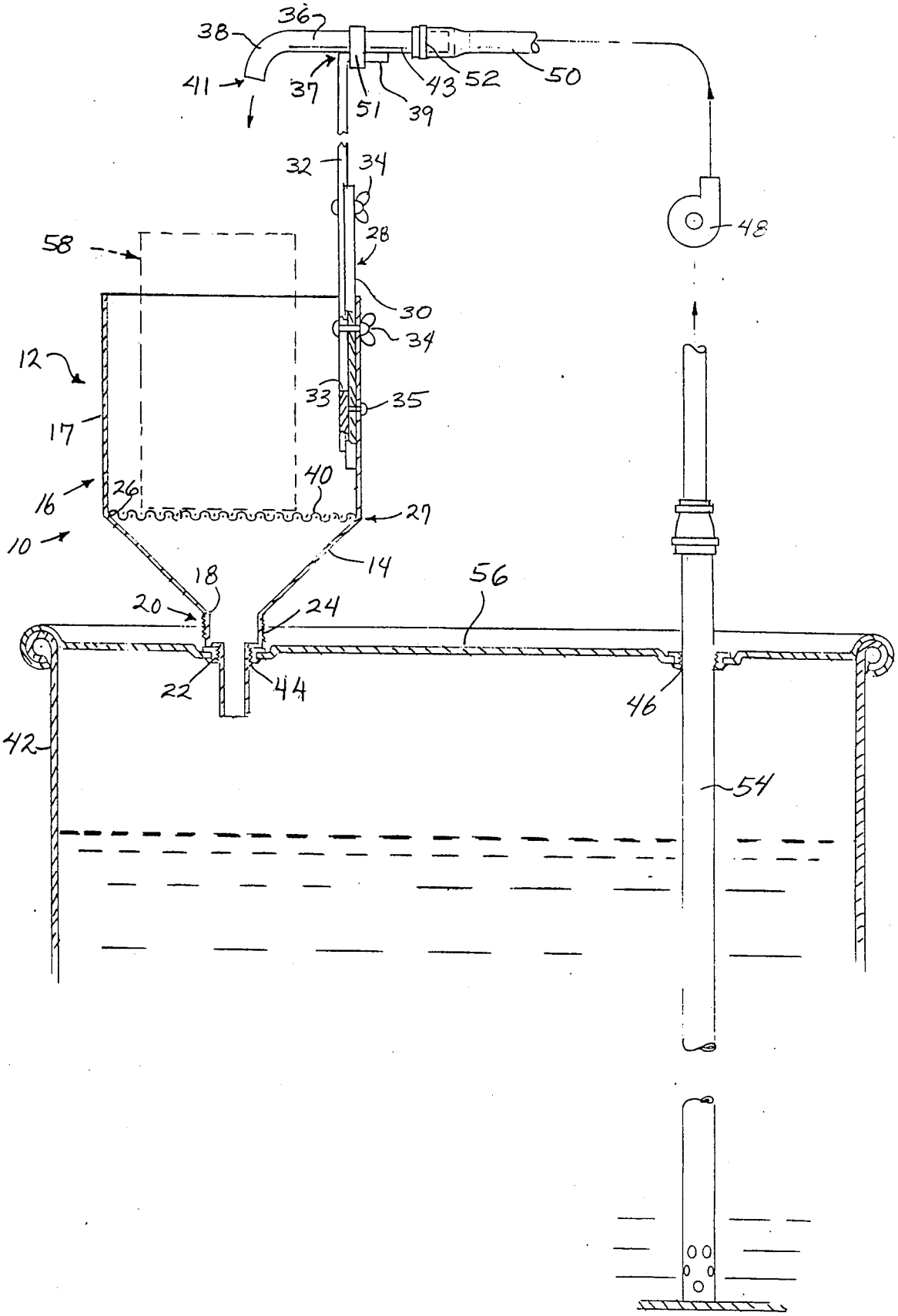
38
36
41
37
51
39
43
52
50
32
34
28
48
58
30
34
12
33
35
17
40
16
26
27
10
14
18
56
20
24
22
44
46
42
54

APPARATUS FOR FACILITATING LIQUID TRANSFER FROM A DRUM

This invention relates to liquid dispensing, and more particularly to an apparatus which facilitates the transfer of liquid from a 55 gallon drum.

A common type of container for liquids is the 55 gallon drum. These drums are frequently used in industrial applications and the like where relatively large quantities of liquids are used. However, in many cases, the amount of liquid which is used at any given time is relatively small. Thus, the liquid must be extracted from the 55 gallon drum and placed in an appropriate container for the immediate use. For example, cleaning solution may be purchased in 55 gallon drum units but only a relatively small amount of the cleaning fluid used at any one time. Thus, the cleaning solution contained in the 55 gallon drum must be transferred to a smaller container for immediate use.

A fairly common way of removing liquid from a 55 gallon drum is by pump. The pump will typically have an inlet pipe which is placed in the 55 gallon drum through one of the drum's inlet ports. Typically, a 55 gallon drum will have two inlet ports in its top cover or lid. Generally, these two inlet ports are different in size, one typically being ¾" IPT (internal pipe thread) in diameter and the second typically being 2" IPT in diameter. Generally, both inlet ports are threaded.

A problem which frequently occurs when using a pump to extract liquid from a 55 gallon drum is that liquid is often splashed or spilled on the floor. Illustratively, the pump has an outlet hose or port which is used to direct the liquid into a container, such as a one gallon or five gallon pail. However, the pail must usually be held under the outlet port of the pump or the pump's outlet hose placed in the pail. Not only does this present the possibility that the pail may be tipped over while the liquid is being pumped, but if the pail or outlet hose is jostled, the liquid may spill outside of the pail. Further, a pail will occasionally be overfilled causing liquid to spill out of the pail. In some cases, due to the nature of the pump, there is a residual flow of liquid after the pumping action has been stopped. Thus, there may be some leakage from the pump after the pail is removed from the pump's outlet port or hose. Not only does this require that the spilled liquid be cleaned up, but it may cause environmental and safety problems, depending upon the nature of the liquid. Also, the liquid is lost.

Another problem which is encountered when using liquid stored in 55 gallon drums is that dirt or other contaminants sometimes get into the drum. The user is then faced with the problem of filtering the contaminants from the liquid.

It is an object of this invention to provide an apparatus which facilitates liquid transfer from a drum which prevents loss of the liquid due to spills or the like.

It is another object of this invention to provide an apparatus which facilitates liquid transfer from a drum which avoids environmental and safety problems caused by spilling liquid from the drum when attempting to extract liquid from the drum.

It is another object of this invention to provide an apparatus which facilitates filtering of contaminants from liquid stored in a drum.

The apparatus for facilitating liquid transfer from a drum comprises a receptacle having a lower portion and an upper portion. The lower portion comprises a hollow, generally conical member having at its apex a fluid coupling having first and second threaded portions. The first threaded portion is more distal from the apex of the conical member than the second threaded portion. The first threaded portion has an outside diameter smaller than the outside diameter of the second threaded portion. The first threaded portion of the fluid coupling is adapted to threadably engage a first threaded port of a drum. The second threaded portion of the fluid coupling is adapted to threadably engage a second threaded port of the drum. The second threaded port of the drum has a diameter larger than the first threaded port of the drum. The upper portion of the receptacle comprises a cylindrical skirt extending axially from the periphery of the base of the conical member. The apparatus can also include a second fluid coupling adapted to mate with an outlet of a pump such as an outlet hose. An adjustable mounting bracket extends axially from the cylindrical skirt and includes means for mounting the fluid coupling on a distal end of the mounting bracket. Illustratively, the second fluid coupling can comprise a pipe having a generally 90° elbow to permit an outlet end of the pipe to open above the apex of the conical member. Further, a filter screen can be provided which is adapted to be received generally at the periphery of the base of the conical member.

Additional features and advantages of the invention will become apparent to those skilled in the art upon consideration of the following detailed description of a preferred embodiment, exemplifying the best mode of carrying out the invention as presently perceived.

Referring to the drawing, an apparatus 10 for facilitating liquid transfer from a drum 42 comprises a receptacle 12. Receptacle 12 has a lower portion 14 and an upper portion 16. The lower portion 14 is a conical member having an egress at its apex 18 from which a fluid coupling 20 extends. Fluid coupling 20 includes a first threaded portion 22 and a second threaded portion 24. The first threaded portion 22 is more distal from the apex 18 of conical member 14 than the second threaded portion 24. First threaded portion 22 has an outside diameter which is smaller than the outside diameter of second threaded portion 24.

First threaded portion 22 and second threaded portion 24 permit the apparatus 10 to be screwed into one of the two threaded ports which the cover or lid of 55 gallon drum 42 typically has. The 55 gallon drum 42 has a top cover or lid 56 which has extending therethrough a first threaded port 44 and a second threaded port 46. Typically, the diameter of first threaded port 44 is ¾" IPT and the diameter of the second threaded port 46 is 2" IPT. The outside diameter of first threaded portion 22 of fluid coupling 18 is sized so that first threaded portion 22 will threadably engage first threaded port 44 of 55 gallon drum 42. The outside diameter of second threaded portion 24 of fluid coupling 18 is sized so that second threaded portion 24 will threadably engage the second threaded port 46 of 55 gallon drum 42.

The upper portion 16 of receptacle 12 comprises a cylindrical skirt 17 which extends axially upward, illustratively six inches, from the periphery or edge 26 of the base 27 of conical member 14 and illustratively has a diameter of twelve inches. Illustratively, the upper portion 16 comprises an inlet for receptacle 12. An adjustable mounting bracket 28 extends axially upward from the upper portion 16. Illustratively, adjustable mounting bracket 28 comprises a first slide 30 and a second slide 32. Second slide 32 has a longitudinally extending slot 33 extending therethrough. Thumb screws 34 are inserted through holes in first slide 30 and through the slot 33 in second slide 32. Thus, by loosening the thumb screws 34, second slide 32 can be axially adjusted relative to first slide 30. Illustratively, adjustable mounting bracket 28 can be extended up to eighteen inches. In the embodiment shown in the drawings, one of thumb screws 34 is also used to secure first and second slides 30, 32 to the upper portion 16. A fastener, such as rivet 35, secures the lower end of slide 30 to upper portion 16.

Adjustable mounting bracket 28 has, at a distal end 37, a flange 39 extending radially outwardly from second slide 32. A second fluid coupling 36 is mounted on flange 39 of adjustable mounting bracket 28. Illustratively, second fluid coupling 36 comprises a pipe having a 90° elbow generally adjacent an outlet end 41 so that outlet end 41 opens generally above the apex of conical member 14. Fluid coupling 36 is illustratively mounted to the flange 39 such as by a hoe clamp 51.

An inlet end 43 of fluid coupling 36 is adapted to mate with an outlet of a pump 48, such as an outlet hose 50. Illustratively, the outlet of pump 48 comprises an outlet hose 50 which is placed over the inlet end 43 of second fluid coupling 36 and secured thereto by means such as a hose clamp 52.

Receptacle 12 can also include a filter member 40. Filter 40 is adapted to be received within receptacle 40 and is sized so that it will be supported by conical member 14 generally at the periphery 26 of the base 27 of conical member 14. Illustratively, filter 40 would be a wire mesh screen or the like and constructed such that it could support a container, such as a five gallon pail 58, into which liquid would be dispensed.

In operation, pump 48 is used to pump liquid from 55 gallon drum 42 into container 58. An inlet pipe 54 of pump 48 is inserted through one of the ports in the cover 56 of the 55 gallon drum 42, illustratively second port 46. The outlet hose 50 of pump 48 is, as previously discussed, coupled to the inlet end 43 of second fluid coupling 36. When it is desired to remove liquid from 55 gallon drum 42, container 58 is placed in receptacle 12, illustratively on top of filter 40. The pump is then actuated and liquid transferred from 55 gallon drum 42 by pump 48, through pump outlet hose 50 into second fluid coupling 36 and out of the outlet end 41 of fluid coupling 36 into the container 58.

Should liquid splash out of container 58 or the liquid overflow container 58, it will be directed back into the 55 gallon drum 42 by apparatus 10 rather than spilling on the floor. Further, should the liquid in 55 gallon drum 42 become contaminated, the liquid can be pumped out of 55 gallon drum 42 through fluid coupling 36 and back into 55 gallon drum 42 through filter 40 of apparatus 10. Thus, the contaminants in the liquid stored in 55 gallon drum 42 can be filtered from the liquid.

Although the invention has been described in detail with reference to certain preferred embodiments and specific examples, variations and modifications exist within the scope and spirit of the invention as described and as defined in the following claims.

What is claimed is:

1. An apparatus for facilitating liquid transfer from a drum to a vessel with a return to the drum of unused liquid, comprising receptacle means for receiving and supporting the vessel to which liquid is to be transferred and having an inlet and egress end, the egress end having a first fluid coupling extending therefrom, the first fluid coupling having a threaded portion adapted to be threadably received in a threaded port of the drum, the threaded portion of the fluid coupling comprising first and second threaded portions, the first threaded portion being more distal from the egress end of the receptacle than the second threaded portion, the first threaded portion having an outside diameter less than an outside diameter of the second threaded portion, the first threaded portion adapted to be threadably received in a first threaded port of the drum for returning the unused liquid, the second threaded portion adapted to be threadably received in a second threaded port of the drum which is larger than the first port for returning the unused liquid, the receptacle including an upper skirt and a lower conical member, the apex of the conical member including the receptacle's egress end, the receptacle including an adjustable mounting bracket extending from the upper skirt and means for mounting a second fluid coupling to the adjustable mounting bracket, the second fluid coupling including means for flexibly coupling an inlet thereof to an outlet of a pump, an inlet of the pump being adapted to be independently connected via a further coupling into the drum to extend adjacent the bottom thereof, and the adjustable mounting bracket adjustable to fixedly locate the second fluid coupling in different positions with respect to the receptacle, to accommodate different sized receptacles.

2. The apparatus of claim 1, wherein a filter screen is located within the upper skirt of the receptacle adjacent its connection to its lower conical member.

3. The apparatus of claim 2, wherein the adjustable bracket comprises a slotted slide member adjustably positioned with respect to the upper skirt by screw means.

4. The apparatus of claim 1, wherein the adjustable bracket comprises a slotted slide member adjustably positioned with respect to the upper skirt by screw means.

* * * * *